US010406648B2

(12) United States Patent
Rogers

(10) Patent No.: US 10,406,648 B2
(45) Date of Patent: Sep. 10, 2019

(54) APPARATUS FOR SURFACE ABRASION

(71) Applicant: NewGrind Inc., Coquitlam (CA)

(72) Inventor: Owen Rogers, Surrey (CA)

(73) Assignee: NewGrind Inc., Coquitlam (CA)

( * ) Notice: Subject to any disclaimer, the term of this patent is extended or adjusted under 35 U.S.C. 154(b) by 0 days.

(21) Appl. No.: 15/667,266

(22) Filed: Aug. 2, 2017

(65) Prior Publication Data

US 2018/0015588 A1 Jan. 18, 2018

Related U.S. Application Data

(63) Continuation-in-part of application No. 14/373,514, filed as application No. PCT/CA2013/000049 on Jan. 21, 2013, now abandoned.

(60) Provisional application No. 61/588,635, filed on Jan. 19, 2012.

(51) Int. Cl.

| | |
|---|---|
| ***B24B 23/00*** | (2006.01) |
| ***B24B 7/18*** | (2006.01) |
| ***B24B 47/12*** | (2006.01) |
| ***B24B 55/10*** | (2006.01) |
| ***B24D 7/06*** | (2006.01) |
| ***B24D 7/16*** | (2006.01) |
| *B24B 55/06* | (2006.01) |

(52) U.S. Cl.

CPC ..... *B24B 7/186* (2013.01); *B24B 47/12* (2013.01); *B24B 55/102* (2013.01); *B24D 7/066* (2013.01); *B24D 7/16* (2013.01); *B24B 7/18* (2013.01); *B24B 55/06* (2013.01)

(58) Field of Classification Search

CPC ..... B24B 23/00
USPC ..... 451/353, 350; 15/49.1, 50.1, 99
See application file for complete search history.

(56) References Cited

U.S. PATENT DOCUMENTS

| | | | | |
|---|---|---|---|---|
| 7,261,623 | B1 | 8/2007 | Palushi | |
| 7,326,106 | B1 * | 2/2008 | Rogers | B24B 7/186 15/49.1 |
| 7,357,700 | B2 | 4/2008 | Lundberg | |
| 7,458,883 | B2 | 12/2008 | Wilson | |
| 2011/0300784 | A1 | 12/2011 | Tchakarov | |

* cited by examiner

*Primary Examiner* — Robert A Rose
(74) *Attorney, Agent, or Firm* — Oyen, Wiggs, Green & Mutala LLP

(57) ABSTRACT

An apparatus for abrading a surface is provided. The apparatus includes: a framework with a motor housed therein; a chassis housing a drivetrain, the drivetrain including a drive pulley operative connected to the motor, a plurality of tool assembly pulleys, a belt operatively connecting the drive pulley and the plurality of tool assembly pulleys; a plurality of tool assemblies operatively connected to the drive pulley and the plurality of tool assembly pulleys, each tool assembly including: a tool holder, a tool plate comprising a tool segment with an abrading surface, wherein the tool holder and tool plate are detachably connected by a plurality of equidistantly spaced pins, wherein the number of pins is a multiple of three.

11 Claims, 14 Drawing Sheets

APPARATUS FOR SURFACE ABRASION

REFERENCE TO RELATED APPLICATIONS

This application is a continuation-in-part of U.S. patent application Ser. No. 14/373,514 (published as US 2015/0328739) filed 21 Jul. 2014, which is a national phase application of PCT international application number PCT/CA2013/000049 (published as WO/2013/106917) filed 21 Jan. 2013, which claims priority to U.S. provisional patent application No. 61/588,635 filed 12 Jan. 2012, all of which are incorporated by reference in the entirety herein.

TECHNICAL FIELD

The present invention relates to construction tools. In particular, the present invention relates to an apparatus for resurfacing through abrasion.

BACKGROUND

It is common for home and business owners, developers, and renovators to wish to renew a horizontal surface such as a floor, deck, patio or other indoor or outdoor surface. One means of performing such renewal is to abrade the upper surface of the existing material to provide a newly revealed, cleaner surface, or to prepare the surface for installation thereon of another surface material.

Various abrading apparatus for performing surface abrasion are well known in the prior art. Such prior art apparatus, however, have several drawbacks. Some are limited in the type of power supply they may employ. Others leave undesirable tooling marks in the surface, or fail to abrade the surface sufficiently close to adjoining walls. Still others may overheat and require frequent cooling periods, or may be difficult to service. Others are larger and heavier and making mobility between floors of a building difficult or even impossible.

There is a general desire for apparatus that overcomes one or more of the above-discussed drawbacks.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides an apparatus for abrading a surface comprising: a framework with a motor housed therein; a chassis housing a drivetrain, the drivetrain comprising: a drive pulley operative connected to the motor; a plurality of tool assembly pulleys; a belt operatively connecting the drive pulley and the plurality of tool assembly pulleys; a plurality of tool assemblies operatively connected to the drive pulley and the plurality of tool assembly pulleys, each tool assembly comprising: a tool holder; a tool plate comprising a tool segment with an abrading surface; wherein the tool holder and tool plate are detachably connected by a plurality of equidistantly spaced pins, wherein the number of pins is a multiple of three.

The belt may operatively connect the drive pulley and the plurality of tool assembly pulleys, and the plurality of tool assembly pulleys are configured in an array, whereby lateral or longitudinal displacement of the chassis across the surface to be abraded results in a path of any one tool assembly rotating in one direction to be at least partially overlapped by a path of at least one other tool assembly rotating in the opposite direction. Or, the belt may operatively connect the drive pulley and the plurality of tool assembly pulleys, and the plurality of tool assembly pulleys are configured in an array, whereby lateral or longitudinal displacement of the chassis across the surface to be abraded results in a path of a first tool assembly rotating in one direction to be subsequently fully overlapped by a path a second tool assembly rotating in the opposite direction, resulting in a complete cross cut, as well as being subsequently at least partially overlapped by a path of a third tool assembly.

The apparatus may comprise one drive pulley and five tool assembly pulleys, wherein the array comprises six tool assemblies.

The framework may comprise a laterally extending post on each side, each post configured to receive a weight thereon.

The chassis may comprise an upper chassis plate and a lower chassis plate, and the lower chassis plate may comprise a recess for housing the drive pulley, the plurality of tool assembly pulleys and the belt.

The upper chassis may comprise an opening, wherein an input shaft extending through the opening operatively connects the motor to the drive pulley.

The input shaft and the drive pulley may be operatively connected by a detachable jaw coupling.

The apparatus may comprise a handle connected to the framework, the handle comprising a plurality of articulation points, wherein the handle is configurable in an extended position and a stowed position, wherein in the stowed position the handle is folded within a footprint of the apparatus.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

In drawings which illustrate by way of example only specific embodiments of the invention.

DESCRIPTION

Figure 1:
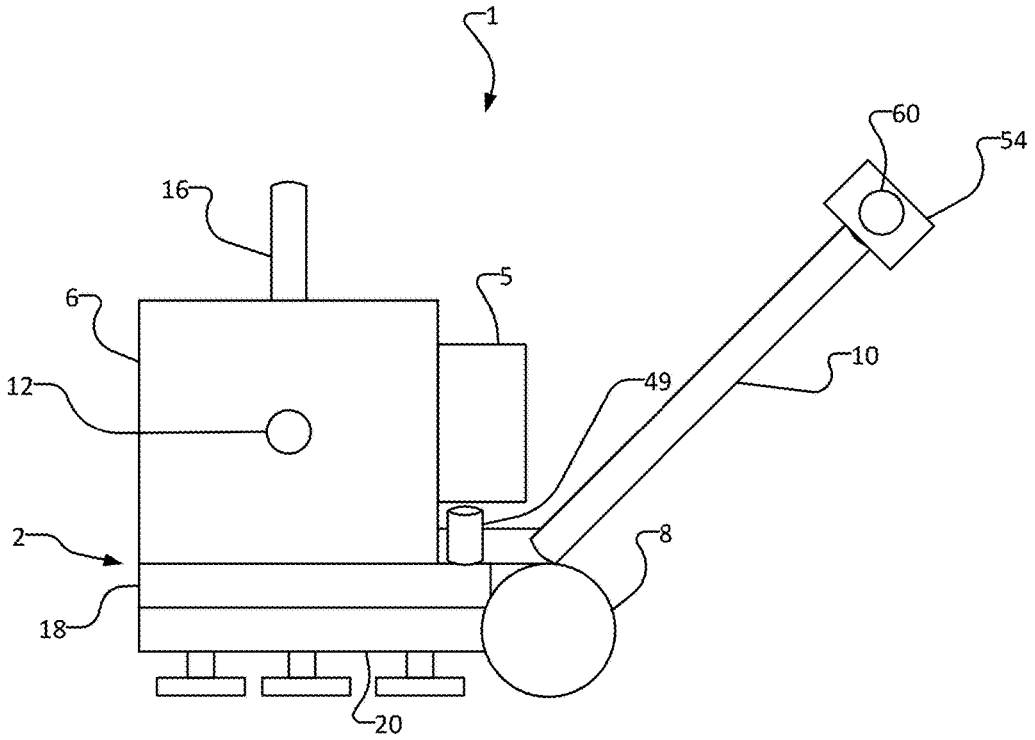
FIG. 1 is a perspective view of a surface abrasion apparatus according to an embodiment of the invention.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

According to aspects of the present invention, there is provided an apparatus for abrading a surface.

As may be seen in FIGS. 1 to 11, a surface abrasion apparatus 1 according to some embodiments of the invention. Apparatus 1 includes a chassis 2 having a motor 4 attached thereon. A variable frequency drive 5 is connected to motor 4, and a framework 6 houses motor 4. A pair of wheels 8 is connected to framework 6 to permit rolling transport of apparatus 1. An elongated handle 10 extends upwardly from chassis 2. A pair of opposing weight posts 12, 14 extends horizontally from opposing sides of framework 6. A third weight post 16 extends vertically from the top of framework 6.

Chassis 2 comprises upper and lower chassis plates 18, 20 having paired openings 22 for insertion of tool plates 24, input shaft 26 for driving a drive pulley 41, and tool assembly pulleys 28 driven by a belt 40. Preferably, an even number of tool assemblies 42 are disposed within an array of an equal number of openings 22 in chassis 2. In some embodiments input shaft 26 may be substituted with a gear that drives drive pulley 41. Idler pulleys 32 occupy two additional openings 34 in chassis 2. Finally, a pair of vacuum ports 36 is disposed on opposing sides of chassis 2.

Figure 3:
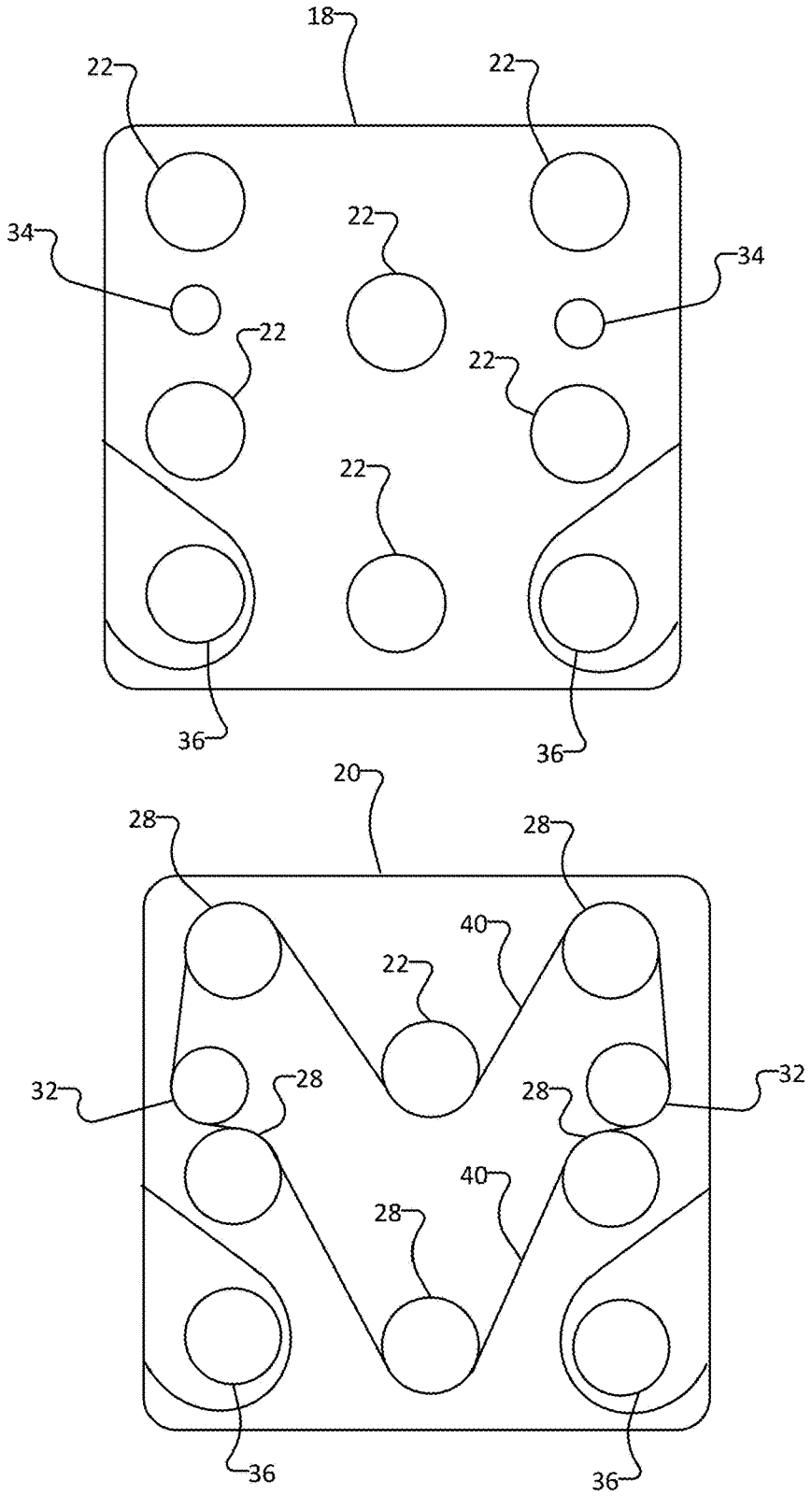
FIG. 3 is a perspective view of the chassis of the apparatus of FIG. 1, showing the upper chassis plate and lower chassis plate separated.
Figure 3A:
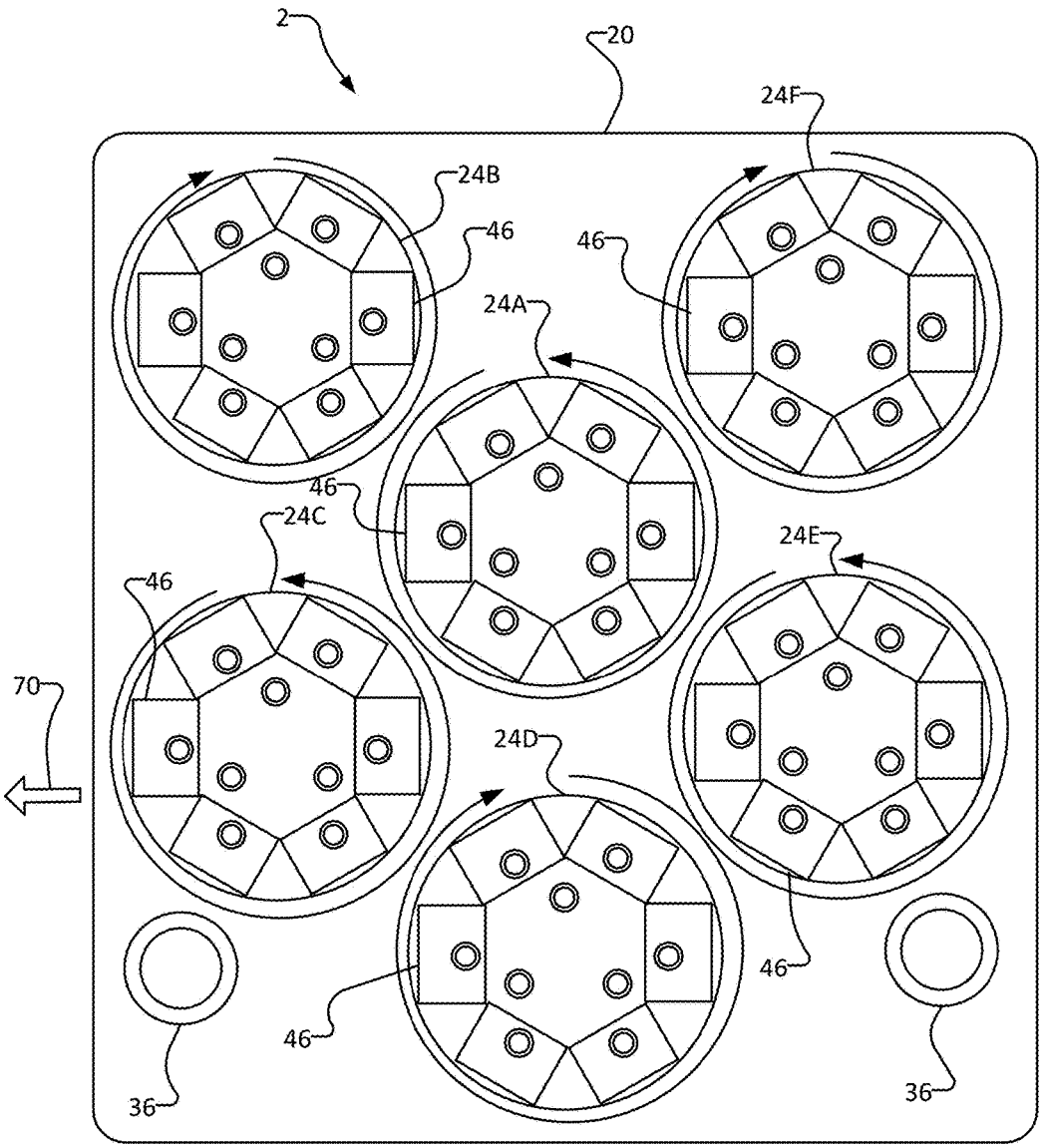
FIG. 3A is a bottom plan view of a surface abrasion apparatus according to another embodiment of the invention, showing the configuration of the tool plate array.
Figure 3B:
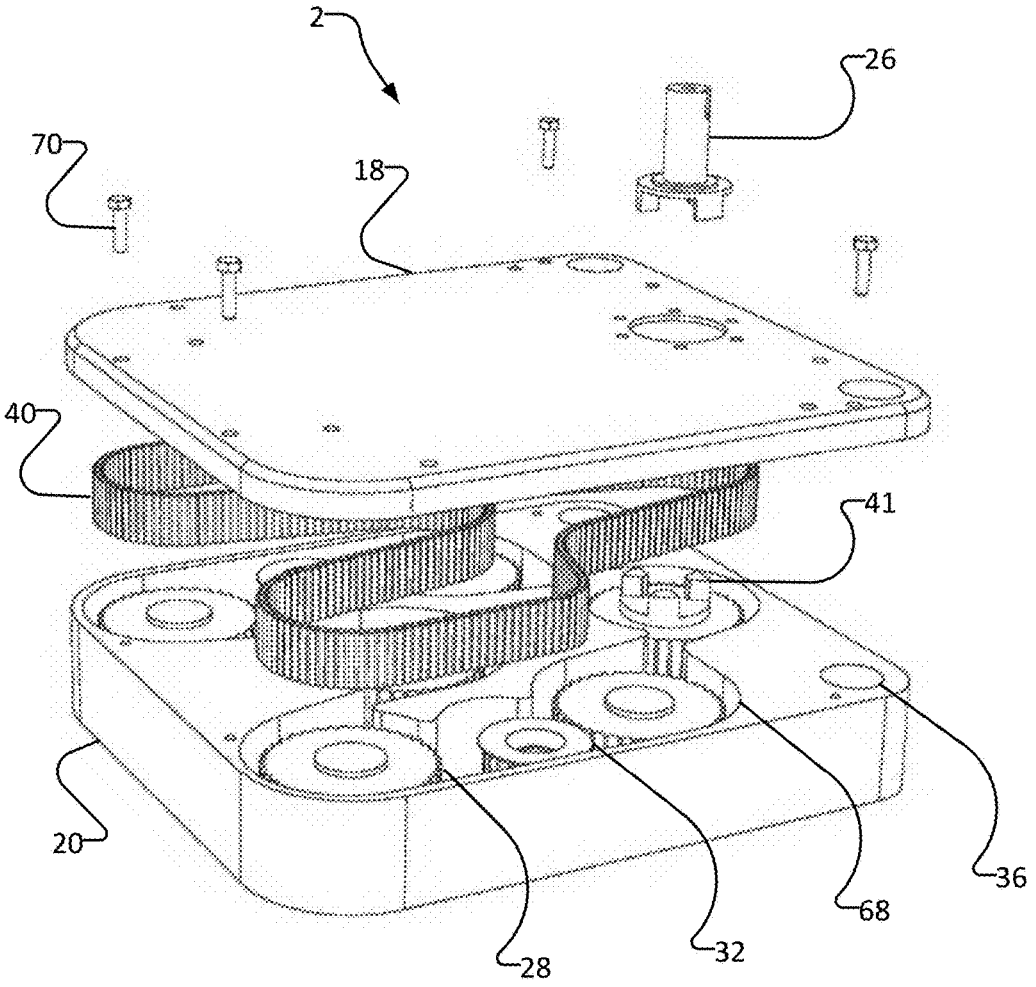
FIG. 3B is a perspective partially exploded view of the chassis of the apparatus of FIG. 3A.

As best illustrated in FIG. 3B, the drive components within chassis 2 (namely tool assembly pulleys 28, idler pulleys 32, belt 40, drive pulley 41 and bearing (not shown) are disposed in a continuous recess 68 in lower chassis plate 20. Upper chassis plate 18 may be attached to lower chassis plate 20 with fasteners 70. Drive pulley 41 of the drive components detachably engages with input shaft 26 via a jaw coupling. Locating all of the drive components in lower chassis plate 20 and providing a jaw coupling between input shaft 26 and drive pulley 41 facilitates quick access for maintenance such as replacement of belt 40, as well as disassembling machine 1 into three pieces for ease in transportation by a single person (instead of two people).

Chassis 2 may be of a monocoque design to dissipate heat. Chassis 2 may be constructed of aluminum to further improve heat dissipation. Improved heat dissipation improves the longevity of the enclosed drive components by pulling away undesirable heat therefrom.

Figure 2:
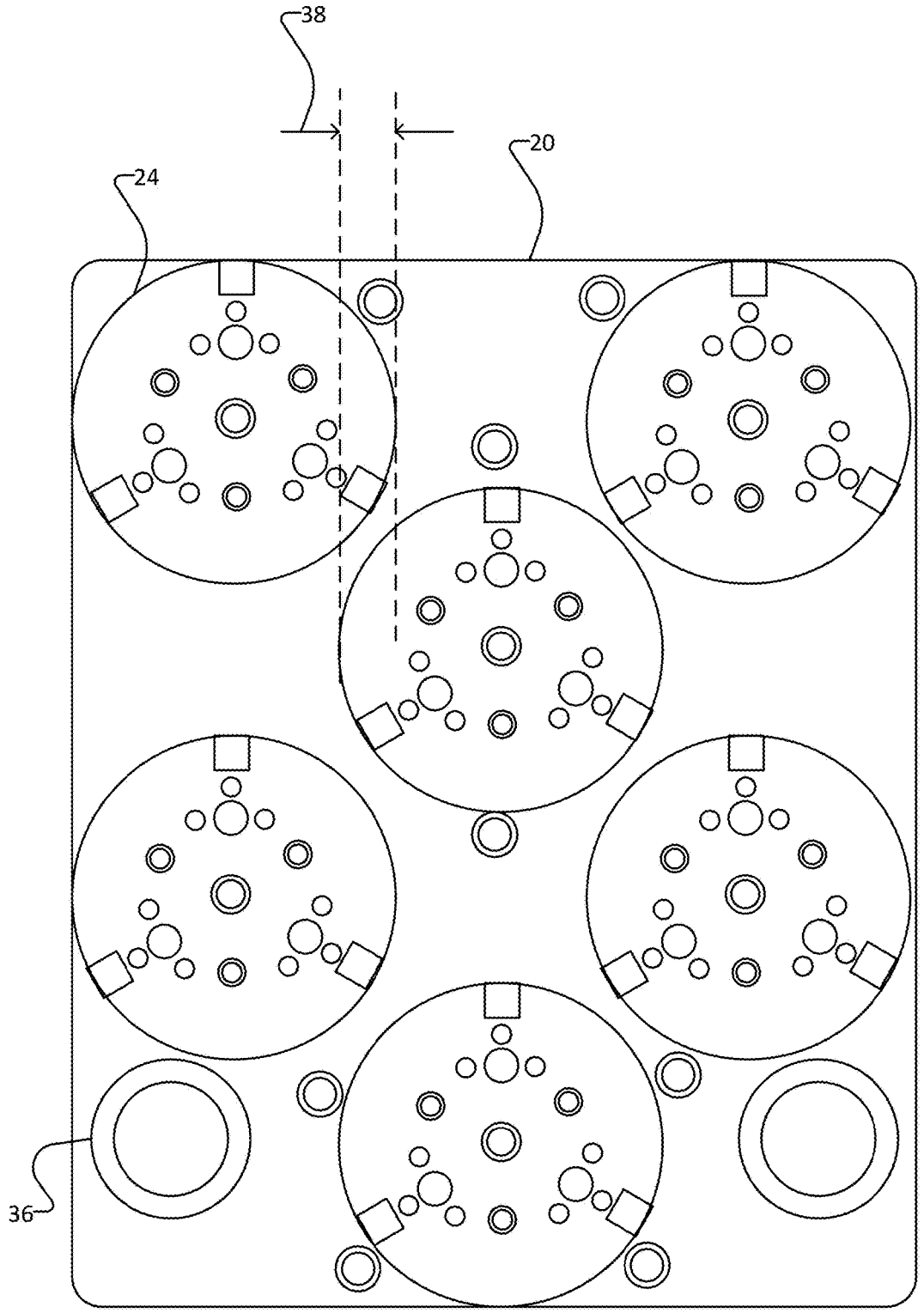
FIG. 2 is a bottom plan view of the apparatus of FIG. 1, showing the configuration of the tool plate array (with tool segments removed)

In some embodiments, an even number of openings are spaced within chassis plates 18, 20 in an alignment which permits a desired overlap 38 between the abrasion area of adjacent tool plates 24, as shown in FIG. 2. This layout is arranged such that there are rows of tooling plates 24 that overlap each other from side to side in a calculated ratio to provide a cutting path that has an even and level tool path profile.

Referring to FIG. 3, rotation of each tool plate 24 is effected by driving rotation of input shaft 26 with motor 4 to rotate drive pulley 26 to run belt 40 interwoven among tool assembly pulleys 28, thereby rotating tool assemblies 42.

As shown in FIG. 3A, tool assemblies 42 are arrayed and counter-rotate with respect to an adjacent one of another such any lateral or longitudinal displacement of chassis 2 across a surface results in a path of one tool assembly 42 rotating in one direction to be at least partially overlapped by the path of at least one tool assembly 42 rotating in the other direction. For example, if chassis 2 were displaced in a leftward direction on the page (arrow 70), then the paths of tool assemblies 24C and 24E rotating counter-clockwise would also be at least partially overlapped by the path of tool assembly 24D rotating clockwise. This six head configuration thus results in both a double cut (since more than one tool assembly 24 will go over a given point on the surface with each pass) and a cross cut (because of the counter-rotation arrangement discussed above) with each pass of apparatus 1, eliminating undesirable track marks left on the surface by known apparatus. In some embodiments, tool assemblies are arrayed and counter-rotate with respect to an adjacent one of another such any lateral or longitudinal displacement of the chassis across a surface results in a path of one tool assembly rotating in one direction to be fully overlapped by the tool assembly following, which will be rotating in the opposite direction, resulting in a complete cross cut, as well as being at least partially overlapped by at least one other rotating tool assembly.

Figure 4:
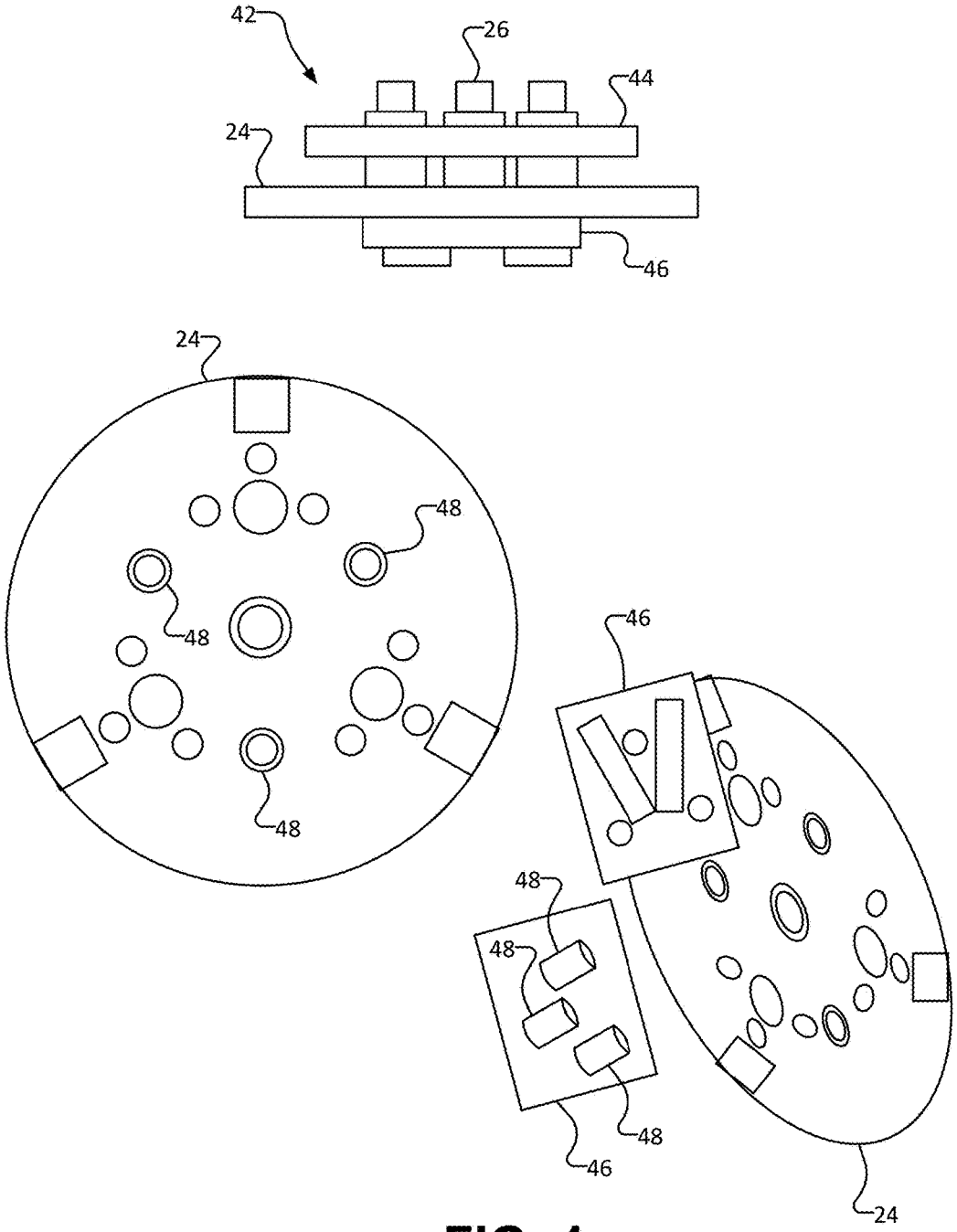
FIG. 4 shows components of the apparatus of FIG. 1: a bottom plan view of a tool plate (with tool segments removed); a side plan view of a tool assembly; and a perspective view of a tool plate with one tool segments attached and one tool segment detached.

With reference to FIG. 4, each tool assembly 42 comprises a tool holder 44 disposed on the lower side of chassis 2, adapted to receive a tool plate 24, and a plurality of tool segments 46 adapted to engage with tool plate 24. Tool plate 24 includes an input shaft 26 which extends upwardly through a pulley 28 within chassis 2. The positioning of the openings of the drive train system of apparatus 1 is designed to ensure that tool plates 24 extend fully to the outer edge of chassis 2 to permit abrasion immediately adjacent a vertical surface such as a wall.

Figure 5:
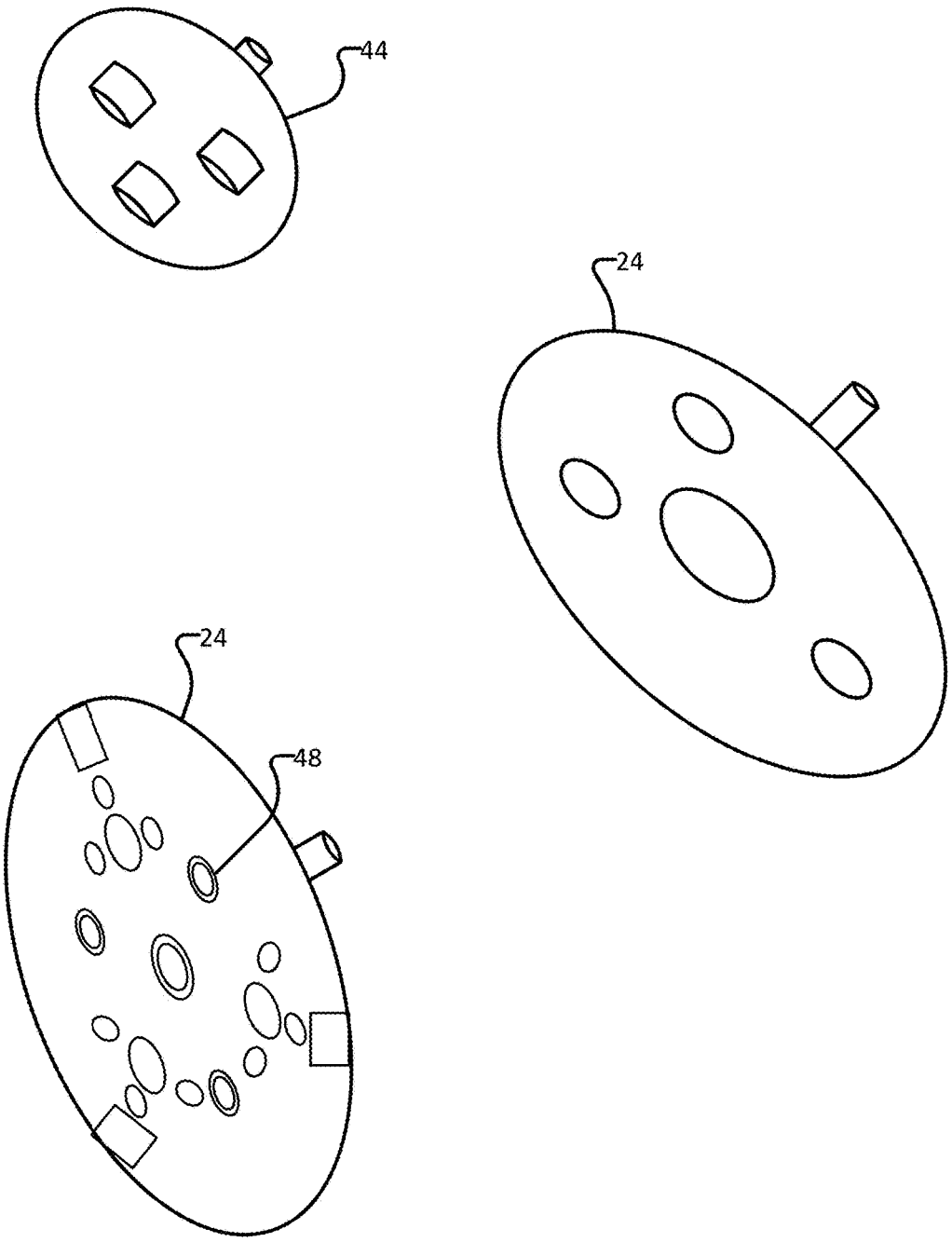
FIG. 5 shows components of the apparatus of FIG. 1: a bottom perspective view of a tool holder; a tool plate having a hook and loop fastener backing; and a tool plate with associated fastening magnets.

Referring to FIG. 5, various means of attachment of each tool plate 24 to a corresponding tool holder 44 are possible. These means may include the use of magnets 48 or hook and loop fasteners (not shown). Tool plates 24 may also comprise a recessed pocket to receive a specifically designed tool retained by a fastener such a screw.

Figure 5A:
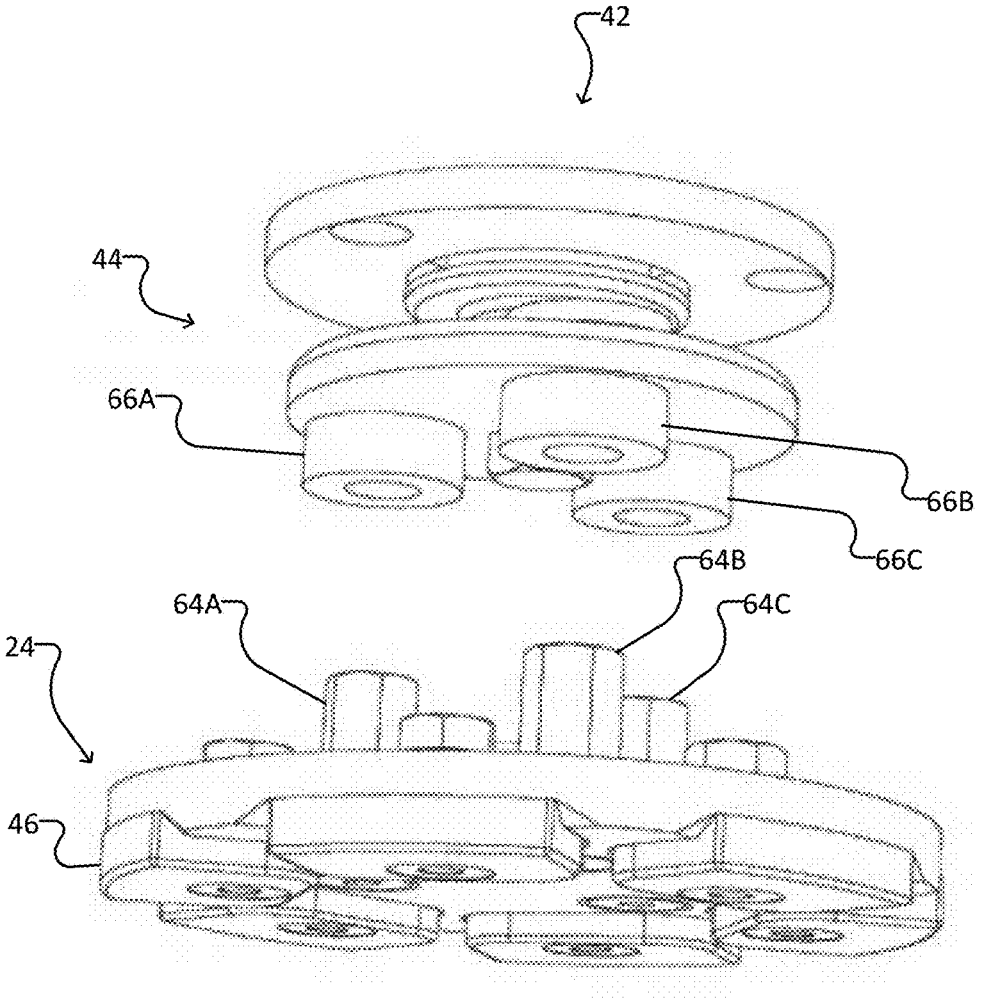
FIG. 5A is a perspective partially exploded view of the tool assembly of the apparatus of FIG. 3A.

Referring to FIG. 5A, tool assembly 42 shows tool plate 24 and corresponding tool holder 44 in further detail. Each tool plate 24 has three equidistant pins 64A, 64B, 64C that engage corresponding equidistant bearings 66A, 66B, 66C of tool holder 44. In some embodiments the bearings may be on the tool plate and the pins on the tool holder. The inventor has determined that this "tripod" pin engagement of tool plate 24 to tool holder 44 permits for even and stable articulation of tool plate assembly 42 across uneven surfaces (compared to known too assemblies with pins in multiples of two, e.g. bipod or quadruped engagement) leading to a smoother finish of the surface and minimizing track marks. In other embodiments, for larger apparatus, the number of pins can be multiples of three, i.e., 6 pins (three groups of 2 pins), 9 pins (three groups of 3 pins), 12 pins (three groups of 4 pins), etc. so long as the tripod arrangement is maintained.

Figure 6:
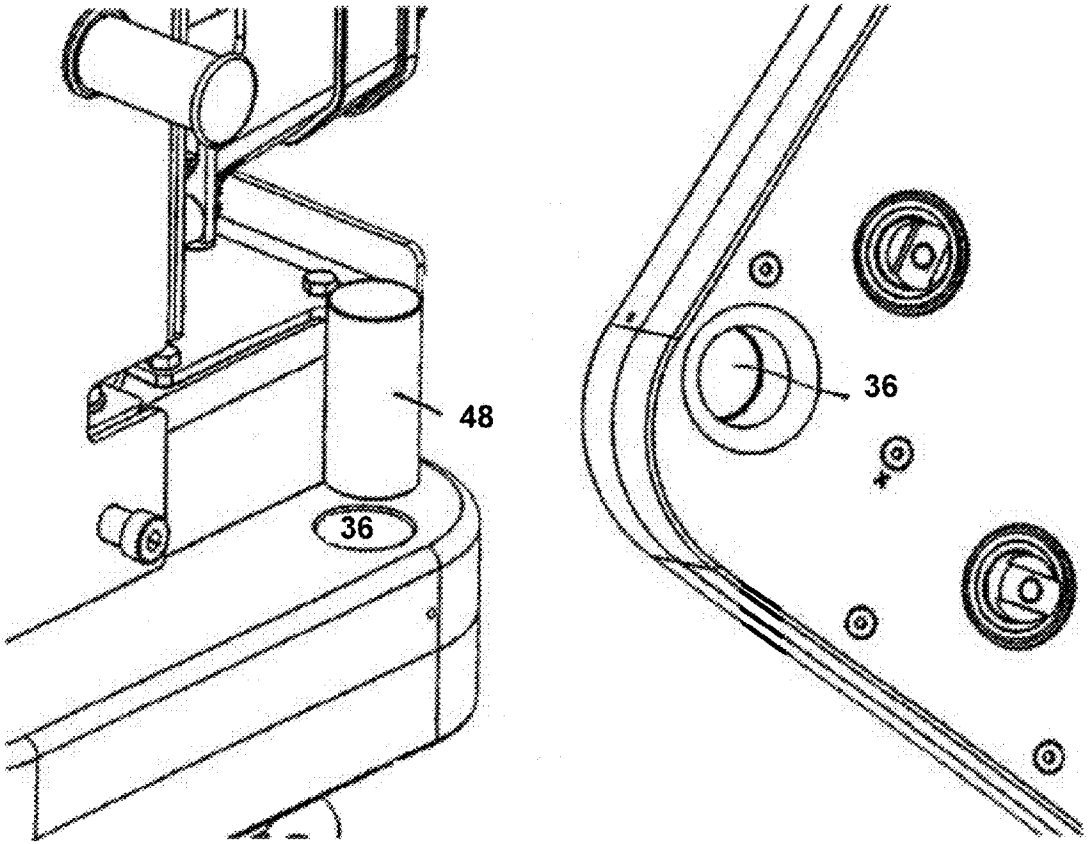
FIG. 6 depicts a vacuum opening and vacuum pipe insertable therein of the apparatus of FIG. 1.
Figure 7:
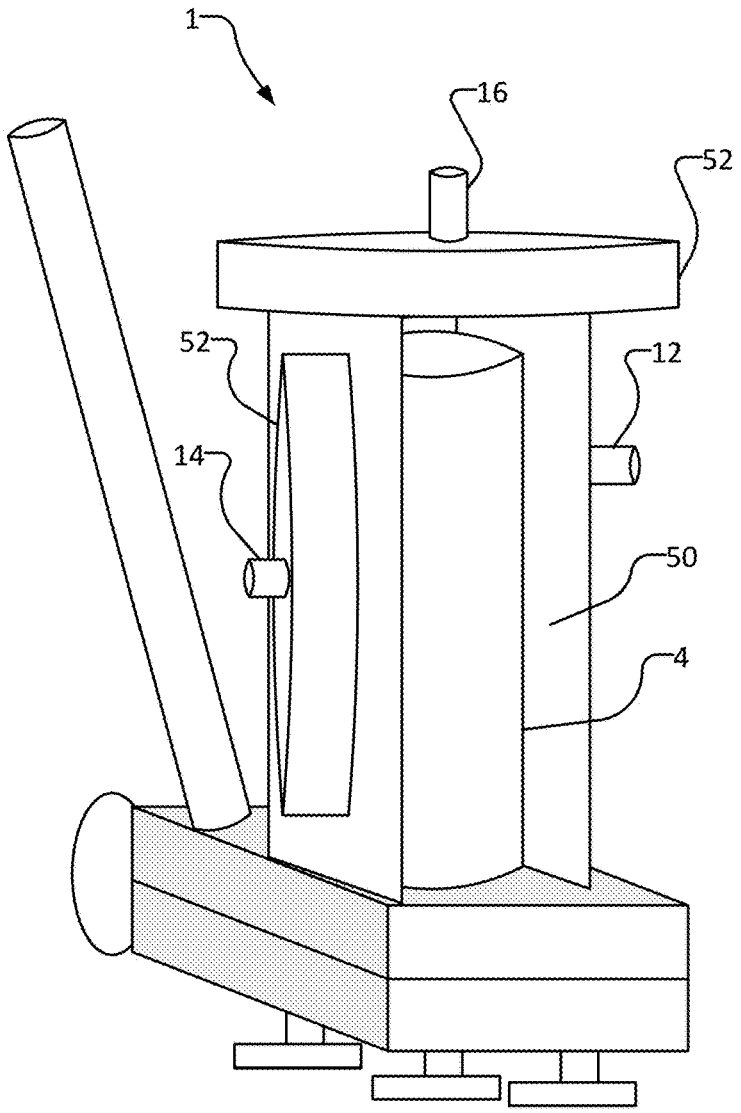
FIG. 7 shows a front perspective view of the apparatus of FIG. 1 with two attached weight plates and one detached weight plate.

As shown in FIG. 6, in addition, a pair of replaceable vacuum pipes 49 may be disposed within vacuum ports 36 on opposing sides of chassis 2 to permit vacuum removal of generated heat, along with debris abraded from the surface being worked upon. A further cooling aspect comprises the placement of framework 6 a spaced distance 50 from motor 4 to permit free flow of air around motor 4 as shown in FIG. 7.

In order to controllingly increase the degree of abrasion of a surface, weights 52 may be added to apparatus 1. As shown in FIG. 7, one or more weights 52 may be added to each of the top post 16 and/or side weight posts 12, 14 to achieve a desired total added weight. Horizontal weight posts 12, 14 and weights 52 added thereon can also be used to adjust the lateral weight balance of apparatus 1 and thus the abrading characteristics thereof to allow a user to define selected point pressure bias depending on the shape or profile of a surface needing abrading. For example, placement of weights 52 can be biased toward a particular lateral side to facilitate polishing "curled up" edges of surfaces, particularly near walls. Weight posts 12, 14, 16 are designed to accept non-proprietary weights thereby allowing the user to add, for example, common Olympic weight plates of varying sizes and weights. Most prior art devices require use of proprietary weights. The biased weight system described herein would only be of benefit for the invention described herein as it would have little to no effect on common planetary machines.

Figure 8:
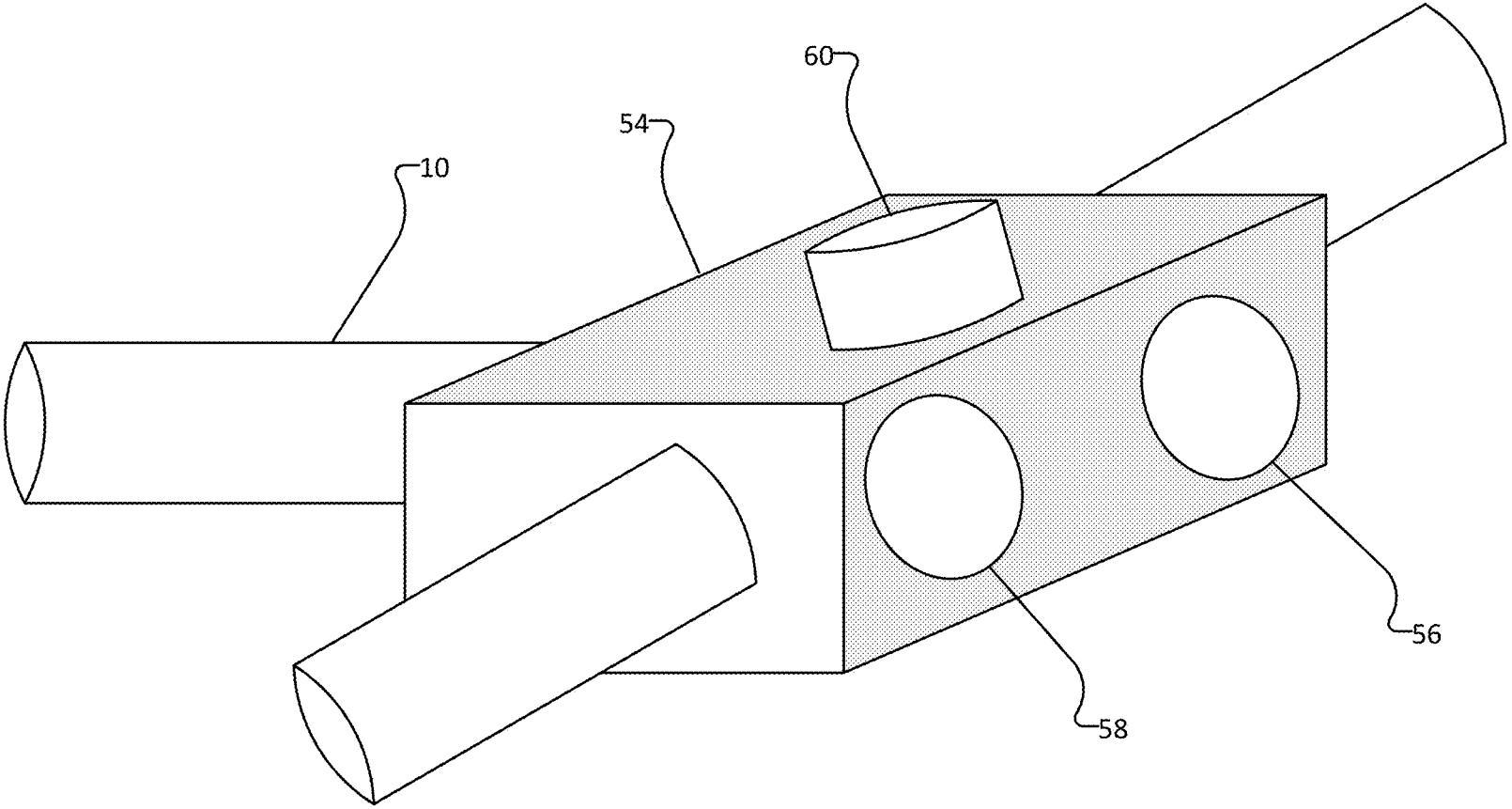
FIG. 8 shows the hand grips and control panel of the apparatus of FIG. 1.

As depicted in FIG. 8, at the upper end of handle 10 of apparatus 1 there is provided a perpendicular crossbar having opposing hand grips, separated by a control panel 54. Control panel 54 may include a forward motion switch 56, a reverse motion switch 58, and an emergency stop switch 60.

Figure 9:
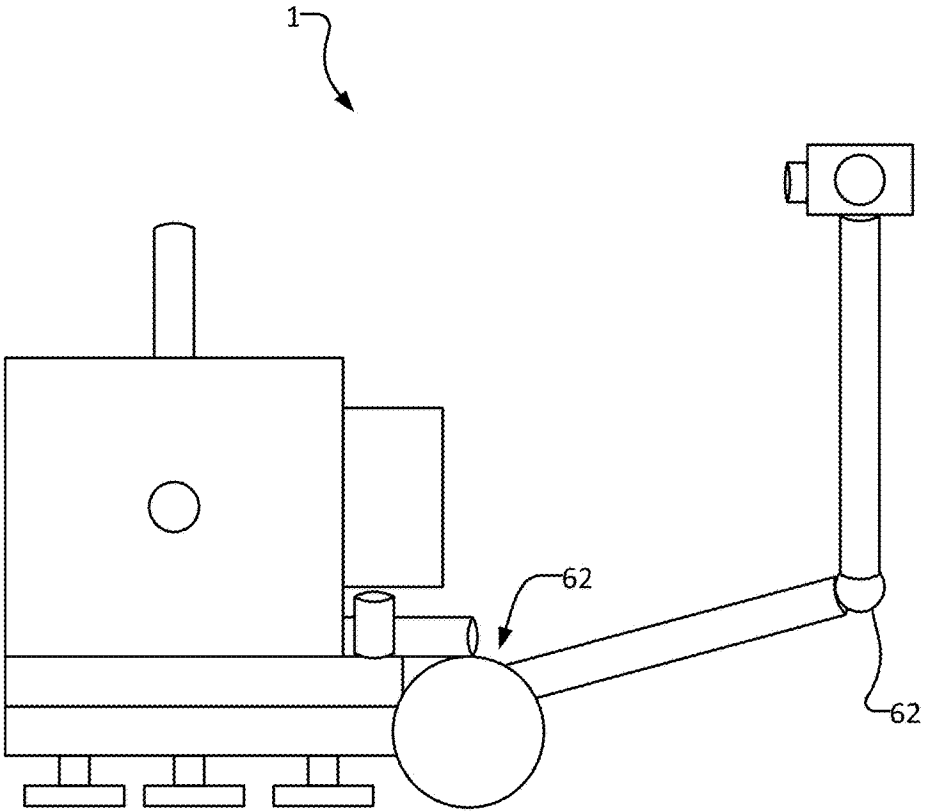
FIG. 9 is a side view of the apparatus of FIG. 1, showing the handle in an extended position.
Figure 10:
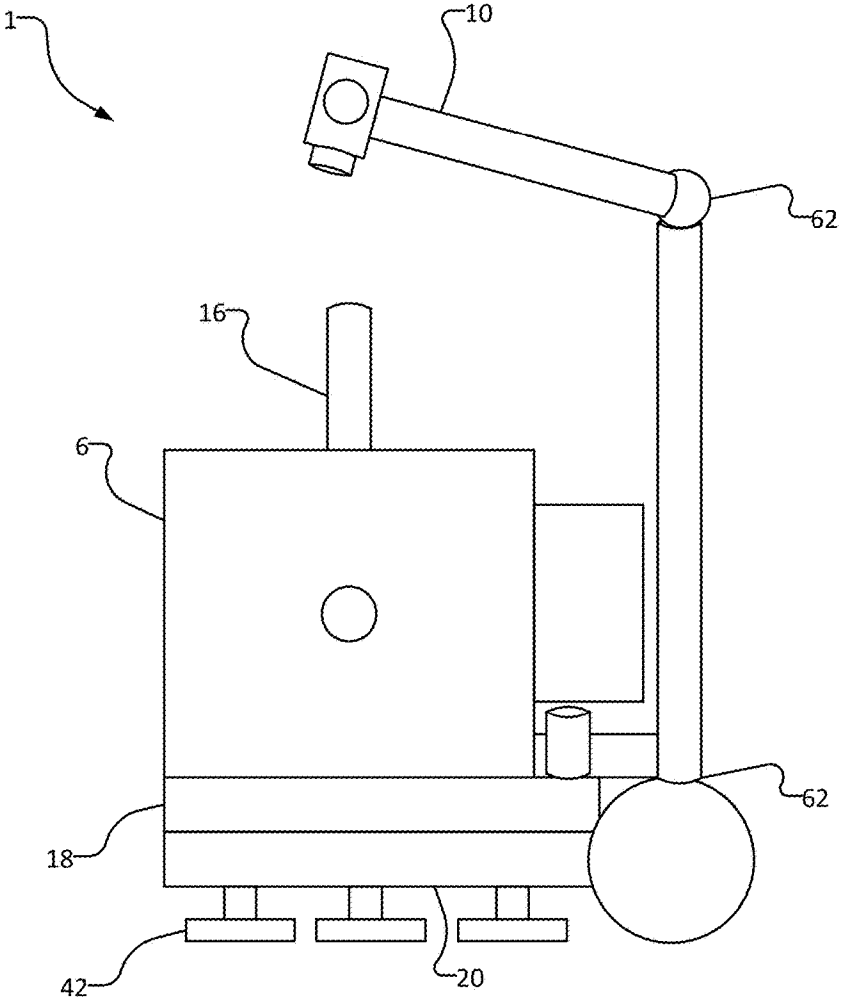
FIG. 10 is a side view of the apparatus of FIG. 1, showing the handle in a stowed position.

Referring now to FIGS. 9 and 10, to permit operation in a variety of circumstances, handle 10 of apparatus 1 is provided with a plurality of articulation points 62 along its length. In some embodiments, such as that illustrated, one articulation point 62 is located approximately midway along handle 10, and another articulation point 62 is located adjacent chassis 2. Adjustment of handle 10 at articulation points 62 permits easier manoeuvrability of apparatus 1. Handle articulations in multiple locations allow apparatus 1 to be operated in tight quarters, backwards, and under height restricted areas. In addition, handle 10 may thereby be folded over framework 6 of apparatus 1 for compact storage and transport, such that handle 10 is folded within the footprint of apparatus 1.

Figure 11:
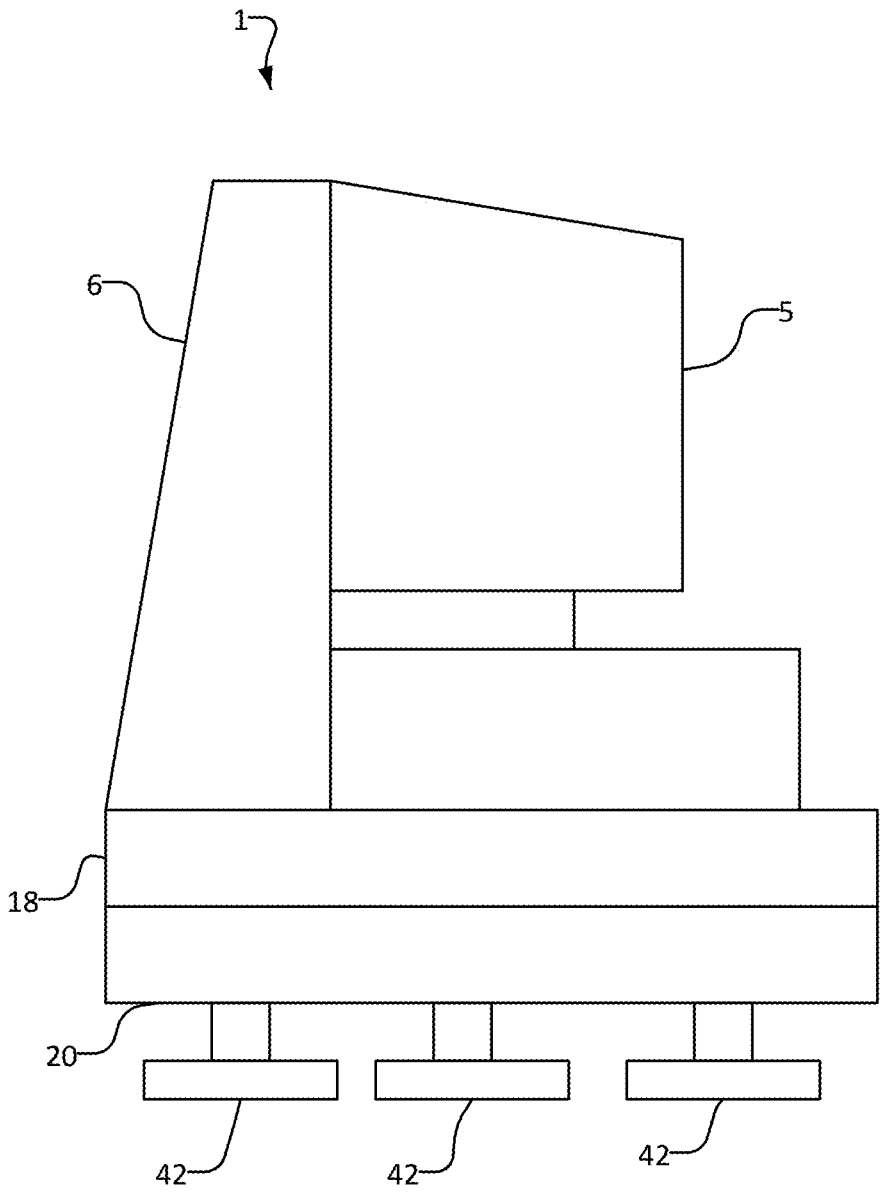
FIG. 11 is a rear view of the apparatus of FIG. 1, showing the variable frequency drive attached to the motor.

Referring to FIG. 11, apparatus 1 is outfitted with a customized variable frequency drive ("VFD") 5 that allows users to use either single or three-phase power sources and to employ variable speed control. VFD also permits current-limiting to suppress current surges and to limit current to a desired maximum as defined within the VFD's programmable parameters.

In operation, the motor, typically electric, variably drives an input shaft in a forward direction, clockwise or counter-clockwise. The input shaft causes a drive pulley to rotate, thereby rotating the drive belt, which in turn rotates each of the tool assembly pulleys and their associated tool plates, to which tool segments are attached. A user moves the apparatus around the surface being abraded to achieve a smooth surface. The motor may also be operated in a reverse direction to effect rotation of the pulleys, belt and tool plates in the opposite direction. A pair of idler pulleys redirects the drive belt around adjacent pulleys.

The apparatus includes a plurality of tool plates, each adapted to receive modified tool segments, which have an abrasive media bonded to their lower surface. The modified tool segments are held in place by the magnet of the tool plate in some embodiments. In some embodiments a recessed pocket may be provided to receive a proprietary tool segment fastened with a fastener such as a screw. In some embodiments, the tool plate may have a hook and loop fastener for attachment of abrasive media having a hook and loop fastener interface. The apparatus further includes a plurality of tool assembly pulleys, each pulley being adapted to rotate a corresponding tool plate; and a plurality of drive shafts in continuous contact with the pulleys via the drive belt such that the tool plates rotate in one direction (counter-rotating with respect to one another as described above) when the forward drive shaft is engaged, and in the opposite direction when the reverse drive shaft is engaged.

A control interface for the apparatus allows for both forward and backward tool rotation which allows the user to re-dress tooling without having to remove the tooling from the apparatus. The symmetrical design of the drive train system permits operation in forward or reverse direction without incident or impact on apparatus service factor.

The drive train system of the apparatus is designed to be easily assembled and serviced in the field by an individual with basic mechanical skills. Unlike prior art apparatus that need to be sent to a repair facility, this drive train can be fully disassembled and re-assembled in approximately 20 minutes with a simple tools and without the use of liquid silicone-type sealers, as the drive train has o-ring seals or precisely machined mating surfaces. The drive train system of the present apparatus is fully sealed and water tight to prevent ingress of foreign debris and other contaminants, including water. All drive shafts extending from the bottom of the apparatus have axis shaft seals mounted in seal plates with o-rings fastened to the base. This allows for the apparatus to be used in both wet and dry conditions.

The vacuum system of the invention has removable vacuum interface pipes on the upper side of the apparatus chassis to allow use of inserts of different sizes for vacuum hoses of varying sizes. The vacuum system also incorporates twin flare type openings at the bottom of the drive train which provides a venturi effect to maximize particulate extraction.

The tool plate driver allows for multiple tool plate options that can be easily installed and removed by a simple pull. The tool plate driver system also has the ability to accept various densities of rubber to further expand the apparatus abrading capability by offering varying degrees of articulation.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

The invention claimed is:

1. An apparatus for abrading a surface comprising:
a framework with a motor housed therein;
a chassis housing a drivetrain, the drivetrain comprising:
a drive pulley operatively connected to the motor;
a plurality of tool assembly pulleys;
a belt operatively connecting the drive pulley and the plurality of tool assembly pulleys;
a plurality of tool assemblies operatively connected to the drive pulley and the plurality of tool assembly pulleys, each tool assembly comprising:
a tool holder;
a tool plate comprising a tool segment with an abrading surface;
wherein the tool holder and tool plate are detachably connected by a plurality of equidistantly spaced pins, wherein the number of pins is a multiple of three, wherein the belt operatively connects the drive pulley and the plurality of tool assembly pulleys, and wherein the plurality of tool assemblies are configured in an array wherein each one of the tool assemblies counter-rotates with respect to an adjacent one of the tool assemblies, whereby lateral or longitudinal displacement of the chassis across the surface to be abraded results in a path of any one tool assembly rotating in one direction to be at least partially overlapped by a path of at least one other tool assembly rotating in the opposite direction.

2. An apparatus according to claim 1 wherein the lateral or longitudinal displacement of the chassis across the surface to be abraded results in a path of a first tool assembly rotating in one direction to be subsequently fully overlapped by a path a second tool assembly rotating in the opposite direction, resulting in a complete cross cut, as well as being subsequently at least partially overlapped by a path of a third tool assembly.

3. An apparatus according to claim 1 comprising one drive pulley and five tool assembly pulleys, wherein the array comprises six tool assemblies.

4. An apparatus according to claim 1 wherein the framework comprises a laterally extending post on each side, each post configured to receive a weight thereon.

5. An apparatus according to claim 1 wherein the chassis comprises an upper chassis plate and a lower chassis plate, the lower chassis plate comprising a recess for housing the drive pulley, the plurality of tool assembly pulleys and the belt.

6. An apparatus according to claim 5 wherein the upper chassis plate comprises an opening, and wherein an input shaft extending through the opening operatively connects the motor to the drive pulley.

7. An apparatus according to claim 6 wherein the input shaft and the drive pulley are operatively connected by a detachable jaw coupling.

8. An apparatus according to claim 1 comprising a handle connected to the framework, the handle comprising a plurality of articulation points, wherein the handle is configurable in an extended position and a stowed position, wherein in the stowed position the handle is folded within a footprint of the apparatus.

9. An apparatus according to claim 1 wherein the path of the tool assembly rotating in one direction is fully overlapped by the path of the tool assembly rotating in the opposite direction during the displacement of the chassis across the surface to be abraded.

10. An apparatus according to claim 9, wherein the path of each of the tool assembly rotating in one direction and the tool assembly rotating in the opposite direction is also partially overlapped by a path of another one of the tool assemblies during the displacement of the chassis across the surface to be abraded.

11. An apparatus for abrading a surface comprising:
a framework with a motor housed therein;
a chassis housing a drivetrain, the drivetrain comprising:
a drive pulley operatively connected to the motor;
a plurality of tool assembly pulleys;
a belt operatively connecting the drive pulley and the plurality of tool assembly pulleys;
a plurality of tool assemblies operatively connected to the drive pulley and the plurality of tool assembly pulleys, each tool assembly comprising:
a tool holder;
a tool plate comprising a tool segment with an abrading surface;
wherein the tool holder and tool plate are detachably connected by a plurality of equidistantly spaced pins, wherein the number of pins is a multiple of three;
wherein the chassis comprises an upper chassis plate and a lower chassis plate, the lower chassis plate comprising a recess for housing the drive pulley, the plurality of tool assembly pulleys and the belt;
wherein the upper chassis plate comprises an opening, and wherein an input shaft extending through the opening operatively connects the motor to the drive pulley; and
wherein the input shaft and the drive pulley are operatively connected by a detachable jaw coupling.

* * * * *